US008955214B2

(12) United States Patent
Varma et al.

(10) Patent No.: US 8,955,214 B2
(45) Date of Patent: Feb. 17, 2015

(54) MOUNTING OF A CONDUCTOR ON A TUBULAR COVER

(75) Inventors: Vinay Varma, Houston, TX (US); Stephen L. Crow, Kingwood, TX (US); Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 304 days.

(21) Appl. No.: 11/948,422

(22) Filed: Nov. 30, 2007

(65) Prior Publication Data

US 2009/0139733 A1 Jun. 4, 2009

(51) Int. Cl.
*H05K 3/34* (2006.01)
*E21B 17/02* (2006.01)

(52) U.S. Cl.
CPC ..... *E21B 17/026* (2013.01)
USPC ..... 29/840; 29/843; 166/66; 166/385

(58) Field of Classification Search
CPC ..... E21B 17/026
USPC ..... 73/706, 756; 166/66, 207, 227, 385; 374/185, 208; 29/840, 842, 843; 385/13–15
See application file for complete search history.

(56) References Cited

U.S. PATENT DOCUMENTS

| | | | | |
|---|---|---|---|---|
| 4,436,276 | A | 3/1984 | Donahue | |
| 4,629,597 | A | 12/1986 | Charlebois et al. | |
| 6,131,462 | A * | 10/2000 | EerNisse et al. | 73/706 |
| 6,264,363 | B1 * | 7/2001 | Takahashi et al. | 374/185 |
| 6,278,811 | B1 * | 8/2001 | Hay et al. | 385/13 |
| 6,457,518 | B1 * | 10/2002 | Castano-Mears et al. | 166/207 |
| 7,037,392 | B2 | 5/2006 | Baumann et al. | |

OTHER PUBLICATIONS

Restarick, Henry; "Horizontal Completion Options in Reservoirs With Sand Problems"; SPE29831; SPE Middle East Oil Show, Bahrain; Mar. 11-14, 1995; pp. 545-560

International Search Report and Written Opinion, Mailed Jul. 10, 2009; PCT/US2008/083956, Written Opinion 7 pages and Search Report 3 pages.

* cited by examiner

*Primary Examiner* — Donghai D Nguyen
(74) *Attorney, Agent, or Firm* — Cantor Colburn LLP

(57) ABSTRACT

A method for securing a signal propagating line to a downhole component includes configuring the downhole component in a final form prior to securing the line thereto; positioning the line at an outside dimension of the component; and fusing the line to the component with a heat based fusion method and apparatus therefore.

11 Claims, 3 Drawing Sheets

MOUNTING OF A CONDUCTOR ON A TUBULAR COVER

BACKGROUND

Signal propagation lines of many types are utilized in the hydrocarbon recovery industry with great regularity. Such lines, although necessary in contemporary hydrocarbon recovery, are extremely helpful for the same must still be accommodated at a downhole tool string in order to be useful. While there are currently a plethora of attachment means utilized in the downhole industry, additional methods are always welcome. This is particularly so in view of the sensitivity of optic fiber signal propagation lines, which are becoming increasingly ubiquitously sought after. Optic fibers are often used as sensory devices by registering strain therein. In view of this mode of operation, however, residual strain from processing of various strain components for from attachment of the optic fiber to strain components can be detrimental to the accuracy and monitoring system utilizing such fiber. Since greater accuracy of monitoring in the wellbore leads to greater productivity in recovery of hydrocarbons from the wellbore, the art is always well receptive of additional methods and configurations to achieve this end.

SUMMARY

A method for securing a signal propagating line to a downhole component includes configuring the downhole component in a final form prior to securing the line thereto; positioning the line at an outside dimension of the component; and fusing the line to the component with a heat based fusion method.

A low residual stress signal propagation line connection system includes a downhole component preformed into a final form; and at least one heat based fusion securing the line to an outside dimension of the component.

BRIEF DESCRIPTION OF THE DRAWINGS

Referring now to the drawings wherein like elements are numbered alike in the several Figures.

DETAILED DESCRIPTION

Referring to all of the figures simultaneously, initially, three alternative concepts are disclosed for securing a signal propagation line to a downhole component while avoiding the introduction of excessive residual stress in the materials surrounding the line or in the line itself. Such stresses introduce anomalous readings from the line when using the same as a sensor. In some cases, the anomalies are significant and thus difficult to miss by a seasoned well operator, but in other cases they may be more subtle thereby rendering them difficult to directly detect. In such situations, a well operator might not even know that there is any anomaly to account for and make decisions that do not ultimately result in a positive change in the productivity of the well. Worse yet, due to the residual stresses, the operator may fail to appreciate a condition in the downhole environment that if left unaddressed, will cause the well to require a workover. Because in such situation where the operator is not aware of a problem, he is unlikely to take prophylactic measures to prevent the necessity of a workover. This lack of preemptive action normally will result in a more costly reactive action.

In order to address the problems discussed above, the present inventors have devised the below described configurations and methods for securing signal propagation lines, and especially optic fiber lines, to downhole components.

Figure 1:
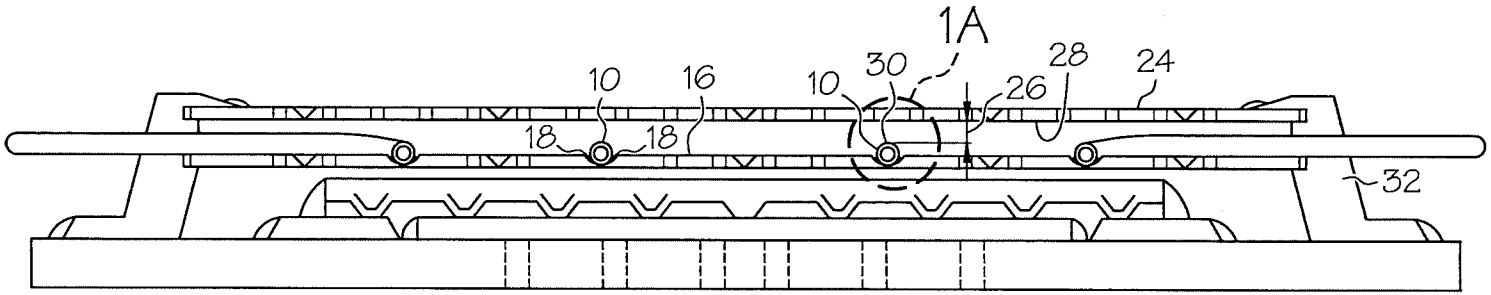
FIG. 1 is a schematic view of a signal propagation line secured at a downhole component.

Referring to FIG. 1, a signal propagation line 10 is illustrated in place on an outside dimension of a cover 12. It will be appreciated by one of skill in the art that the particular illustration places the cover 12 radially outwardly of a sand screen including a shroud. These components are illustrated only for environment and do not make up a part of the invention. Therefore, they need not be specifically discussed.

Figure 1A:
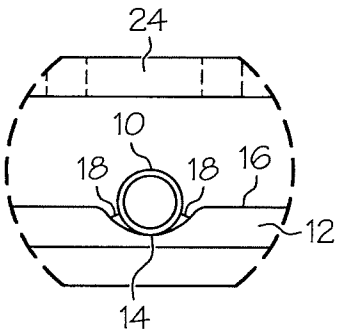
FIG. 1A is an enlarged portion of FIG. 1 that has been circumscribed with line 1A-1A.

Referring to FIG. 1A, an enlarged view of the line 10 at the cover 12 is shown to enable the reader to appreciate the securement of the line 10 to the cover 12. Initially, it is to be noted that the cover 12 in this embodiment includes a depression 14 therein at the outside dimension 16 of the cover 12. The depression 14 is of a size and shape to receive at least part of the line 10 therein. As illustrated, the line is not fully received in the depression 14 but this is also contemplated. The line 10 is secured in the depression by a heat based fusion process such as laser welding at least one longitudinal side of the line 10. As illustrated there are two fusion joints 18. In addition to the foregoing, it is to be understood that in the configuration as illustrated, the line 10 is secured to the cover 12 only after the cover 12 has been itself constructed. One of skill in the art will be familiar with a common method for constructing tubular covers by helically wrapping a strip of material. In such a method of construction, the line 10 is to be secured after the helical winding is completed. Due to the securement only after the helical winding, induced and residual stress is reduced in the line 10. As alluded to above, reduction in stresses in the line 10 related to the securement and or the construction of the cover 12, significantly improve the performance of the line 10 in subsequent operations.

Figure 2:
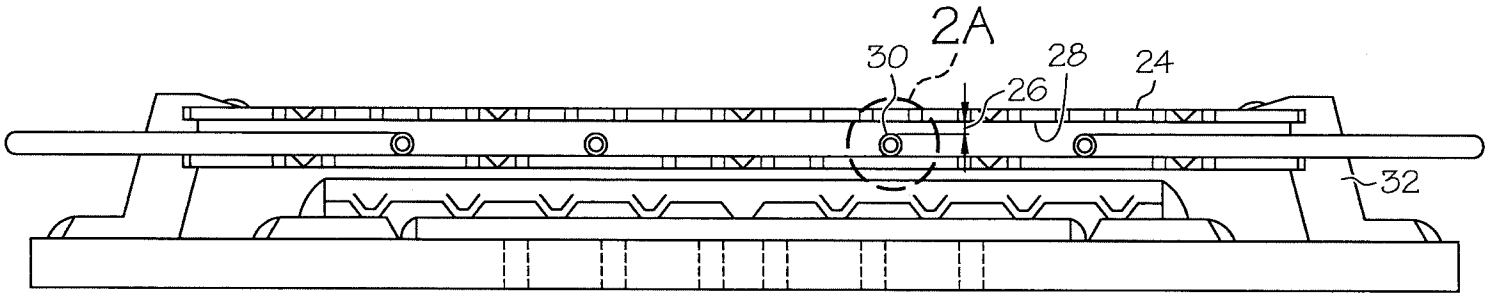
FIG. 2 is a schematic view of another signal propagation line alternately secured at a downhole component.
Figure 2A:
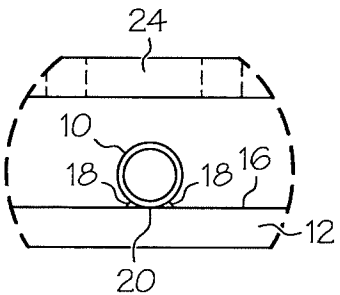
FIG. 2A is an enlarged portion of FIG. 2 that has been circumscribed with line 2A-2A.

In an alternate embodiment and referring to FIGS. 2 and 2A, the line 10 is secured to the cover 12 without the use of a depression 14 but rather simply directly at the outside dimension 16 of the cover 12. Without the benefit of the depression 14, a metal sheet 20 is disposed between the line 10 and the outside dimension 16 of the cover 12. At least one and as illustrated two heat based fusions is/are created at each longitudinal side of the line 10. In one embodiment the fusion is created by a laser weld. Each weld is positioned as illustrated and extends from the cover 12 to the line 10 and incorporates the metal sheet 20 in the joint(s) 18.

Figure 3:
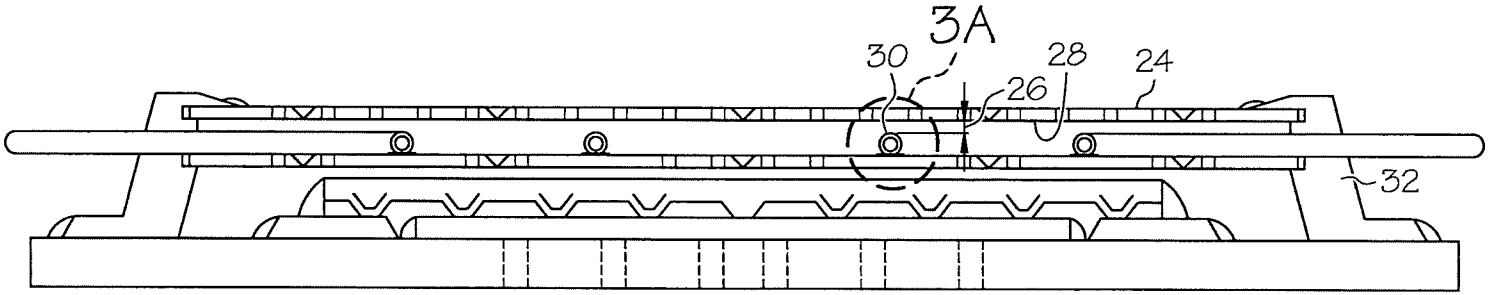
FIG. 3 is a schematic view of another signal propagation line alternately secured at a downhole component.
Figure 3A:
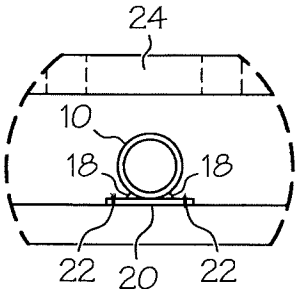
FIG. 3A is an enlarged portion of FIG. 3 that has been circumscribed with line 3A-3A.

In yet another alternate embodiment, and referring to FIGS. 3 and 3A, the line 10 is again placed at the outside dimension of the cover 12 without benefit of a depression 14. In this embodiment, similar to the embodiment of FIG. 2, a metal sheet 20 is employed. By comparing FIGS. 2A and 3A, one will appreciate a distinct difference in the heat based fusion joints employed. In the FIG. 3 embodiment, joints 18 are placed on each longitudinal side (at least one side also being contemplated) of the line 10 as in the foregoing embodiments but those joints 18 do not extend to the cover 12 itself. Rather, they extend only to the metal sheet 20. The metal sheet 20 is then heat based fused to the cover 12.

Because the fusion joints 22 between the sheet 20 and the cover 12 are spaced from the line 10 and the joints 18, stress from the individual joints is reduced as it is spread over a larger surface area.

In each of the embodiments discussed above, the line 10 is positioned at a potentially damage prone location. In order to protect the line from inadvertent damage while, for example, running in the hole, the configurations discussed may sometimes be built with an additional outer cover 24 (as illustrated in each of the figures). The outer cover 24 is a perforate tubular mounted in such a way as to maintain a clearance 26 between an inside dimension 28 thereof and a radially outermost surface 30 of the line 10. The clearance may be any practical clearance to give a buffer between the cover and the line. The outer cover 24 may be mounted as illustrated with support structures 32 fixed to a base pipe 34 by fasteners or fusion means.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A method for securing a signal propagating line, the line configured to sense strain to a downhole component comprising:

configuring the downhole component in a final form by helically wrapping a sheet material into a tubular cover prior to securing the line thereto;

positioning the line at an outside dimension of the component only after the component is helically wrapped into the final form such that stress is not imparted to the line during the helical wrapping of the component, to allow the line to sense strain in the component without experiencing residual strain from the helical wrapping; and fusing the line to the helical wrapped component with a heat based fusion method.

2. The method as claimed in claim 1 wherein the fusing is carried out on both lateral sides of the line.

3. The method as claimed in claim 1 wherein the heat based fusion method is welding.

4. The method as claimed in claim 3 wherein the welding is laser welding.

5. The method as claimed in claim 1 wherein the method further includes positioning an outer cover radially outwardly of the line to protect the same.

6. The method as claimed in claim 5 wherein the outer cover is configured to maintain a clearance between an inside dimension thereof and an outermost surface of the line.

7. The method as claimed in claim 1 wherein the configuring further includes forming a depression in the outside dimension of the component, the depression being at least partially receptive to the line.

8. The method as claimed in claim 7 wherein the fusing is carried out within the depression.

9. The method as claimed in claim 1 wherein the positioning further includes interposing a sheet of thin metal between the line and the component.

10. The method as claimed in claim 9 wherein the fusion incorporates the metal sheet.

11. The method as claimed in claim 9 wherein the fusing includes fusing the line to the sheet and separately fusing the sheet to the component.

* * * * *